US009591925B2

(12) United States Patent
Qureshi et al.

(10) Patent No.: US 9,591,925 B2
(45) Date of Patent: Mar. 14, 2017

(54) SEATING CUSHION FOR TREATING PELVIC PRESSURE, PAIN AND DISCOMFORT

(71) Applicants: Ambreen S Qureshi, Columbus, OH (US); Asif M. Sheikh, Columbus, OH (US)

(72) Inventors: Ambreen S Qureshi, Columbus, OH (US); Asif M. Sheikh, Columbus, OH (US)

( * ) Notice: Subject to any disclaimer, the term of this patent is extended or adjusted under 35 U.S.C. 154(b) by 4 days.

(21) Appl. No.: 13/924,007

(22) Filed: Jun. 21, 2013

(65) Prior Publication Data

US 2014/0375089 A1 Dec. 25, 2014

(51) Int. Cl.
*A47C 7/02* (2006.01)
*A47C 7/74* (2006.01)

(52) U.S. Cl.
CPC ..... *A47C 7/021* (2013.01); *A47C 7/022* (2013.01); *A47C 7/748* (2013.01)

(58) Field of Classification Search
None
See application file for complete search history.

(56) References Cited

U.S. PATENT DOCUMENTS 4,842,330 A * 6/1989 Jay ..... 297/4
4,965,899 A * 10/1990 Sekido et al. ..... 297/284.6
5,018,790 A * 5/1991 Jay ..... 297/452.26
5,343,876 A * 9/1994 Rogers ..... 5/653
5,681,092 A * 10/1997 Hanson et al. ..... 297/452.41
6,030,338 A * 2/2000 Benderev ..... 600/30
6,036,271 A * 3/2000 Wilkinson ..... A61G 5/1043 297/219.1
6,179,769 B1 * 1/2001 Ishikawa et al. ..... 600/9
6,436,029 B1 * 8/2002 Benderev ..... 600/30
7,220,376 B2 * 5/2007 Hetzel et al. ..... 264/125
7,882,574 B2 * 2/2011 Arsenault et al. ..... 2/227
8,713,733 B2 * 5/2014 Caforio ..... 5/648
D713,665 S * 9/2014 Caforio ..... D6/716.1
2008/0004679 A1 * 1/2008 Naghavi et al. ..... 607/108
2008/0009926 A1 * 1/2008 Russak et al. ..... 607/109
2011/0277246 A1 * 11/2011 Willingham ..... A47C 3/12 5/653
2012/0098310 A1 * 4/2012 Bryer ..... A47C 7/021 297/284.4
2012/0137441 A1 * 6/2012 Caforio ..... A47C 7/022 5/652
2013/0085553 A1 * 4/2013 Kang ..... 607/100
2013/0283535 A1 * 10/2013 West ..... 5/653
2015/0015042 A1 * 1/2015 Willingham ..... A47C 7/022 297/284.7
2015/0052685 A1 * 2/2015 Bhat ..... A61G 7/05769 5/715

FOREIGN PATENT DOCUMENTS

WO WO 2011019165 A2 * 2/2011

* cited by examiner

*Primary Examiner* — David E Allred
(74) *Attorney, Agent, or Firm* — Miracle IP; Bryce D. Miracle

(57) ABSTRACT

A seating cushion for treating and alleviating pain and discomfort related to pelvic pressure and pelvic organ prolapse. The seating cushion applies pressure to the pelvic crotch area of a user. The seating cushion comprises a base cushion portion for providing padding and an elevated and elongated central portion for applying pressure to the pelvic crotch area of a user while the user is seated thereon.

7 Claims, 14 Drawing Sheets

SEATING CUSHION FOR TREATING PELVIC PRESSURE, PAIN AND DISCOMFORT

BACKGROUND

This disclosure relates to the treatment of pelvic discomfort related to pelvic pressure and pelvic organ prolapse (POP).

Pelvic pressure and pelvic pain are very common conditions that affect the majority of women. Women often have pelvic pressure and sometimes pain due to a myriad of reasons. It is even more common for women to have pelvic pressure related to their menstrual cycle. Most women experience pressure and sometimes pain before and during menstruation also known as dysmenorrhea. Moreover, pain related to ovulation, known as mittelschmerz pain, is experienced by the majority of women, some every menstrual cycle, and some intermittently. In terms of severity, the pain involved with the female cycle can range from mild pressure in the pelvic region to severe pain and nausea.

Some physical actions can also cause discomfort, such as excessive vaginal and anal intercourse or merely standing for a prolonged period of time.

Further, pelvic organ prolapse (POP) is a very common condition which occurs in about 50% of women who have had vaginal childbirth. POP mainly results from damage and the breakdown of support structures within the pelvis. Normally the pelvic organs are kept in place by muscle and connective tissue attachments, such as ligaments, but in pelvic organ prolapse these structures fail in their functions. This results in the uterus dropping down into the vagina and, in severe cases, outside the vagina. In a first-degree uterine prolapse, the uterus is only slightly lower than its normal position; most women are not aware of this other than the feeling of slight pressure in the pelvic region. A further drop creates a second-degree prolapse, which women usually notice. A third-degree prolapse occurs when the uterus drops low enough for the vagina to be completely filled, causing the cervix to reach the opening of the vagina.

Pelvic organ prolapse may arise for a variety of reasons, including accidental trauma, surgery such as a hysterectomy, weakening due to age or disease, work habits, intercourse, obesity, frequent constipation, pelvic organ tumors, or the like. However, it is most often linked to the strain and damage caused by vaginal child birth.

A range of symptoms are associated with pelvic organ prolapse, such as a feeling of pressure from the organs pressing against the vaginal wall, feeling very full in the lower abdomen, urinary incontinence or inability to empty the bladder completely, pain in the vagina, constipation, and incomplete or difficult bowel emptying.

Current treatment options range from medication that alleviate pain to dietary and lifestyle changes and exercises that strengthen the pelvic muscles. These options, however, are only effective for women with mild symptoms. In more severe cases, the use of a pessary device or even surgery is required.

There exists a need for alternative treatment options for pelvic related pressure, discomfort, and the side effects of pelvic organ prolapses. A preferred treatment option would remedy the condition in a safe, minimally invasive and effective manner; this treatment would reduce pain and other complications.

SUMMARY

For the foregoing reasons, what is needed is a seating cushion that applies pressure to the pelvic crotch area of a user. The applied pressure to the crotch area will provide relief from pelvic pain and pressure, including menstrual cycle discomfort related to ovulation and pressure caused from pelvic organ prolapse.

In accordance with the invention, a seating cushion is provided that applies pressure to the pelvic crotch area of a user. In a version, the seating cushion comprises a base cushion portion and an elevated and elongated central portion for applying pressure to the crotch area of the user while the user is seated thereon. While in use, the elevated and elongated central portion is aligned lengthwise within the user's crotch area. This creates an upward applied pressure to the crotch area and pelvic region in response to the user's weight on the seating cushion.

In a version of the invention, the base cushion portion further comprises a substantially planar bottom surface and a top surface opposed to the bottom surface, the top surface having laterally opposed left and right sides for adapting to a user's thighs and buttocks while the user is seated thereon. The base cushion portion generally has sufficient padding that provides comfort to the user while the seating cushion is sat on. Moreover, the elevated and elongated central portion for applying pressure to the crotch area of the user extends lengthwise between the right and left sides of the top surface, wherein the elevated and elongated central portion generally has an outer curved surface.

The elevated and elongated central portion can be variably shaped and sized providing that it sufficiently applies pressure to the user's groin area. Preferably, the elevated and elongated central portion can be in the shape of a cylinder, half cylinder, or other shape with an outer curved surface. The outer curved surface of the elevated and elongated central portion can be of a variable shape and have a variable elevation relative to the top surface of the base cushion portion. Optionally, the outer curved surface can be inwardly or outwardly curved, convex, concave, or in a mounded configuration. Preferably, the elevated and elongated central portion is substantially in the shape of a cylinder that horizontally extends lengthwise near the center of the base cushion portion and is optionally made of foam.

In another version of the invention, the elevated and elongated central portion is removable and interchangeable with other elevated and elongated central portions that are of different shapes, sizes, and firmness. Thus, if a user desires an elevated and elongated central portion that provides alternative characteristics, she can remove the portion from the base cushion portion and replace it with another portion that provides characteristics that are more well suited for the user's needs. Each user's needs may vary depending on the degree of pain and the severity of their condition.

In yet another version of the invention, a heating apparatus is provided and utilized in conjunction with the seating cushion. The heating apparatus applies heat to the frontal pelvic region in conjunction with the applied pressure from the elevated and elongated central portion of the seating cushion. The combined strengths of both unique features significantly help to reduce pelvic area pain and pressure.

Preferably, the heating apparatus is a heating pad that generally conforms to the shape of the frontal pelvic area that is held into place by a waist strap and is optionally attached near the front of the base cushion portion by a fastener.

Still other benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
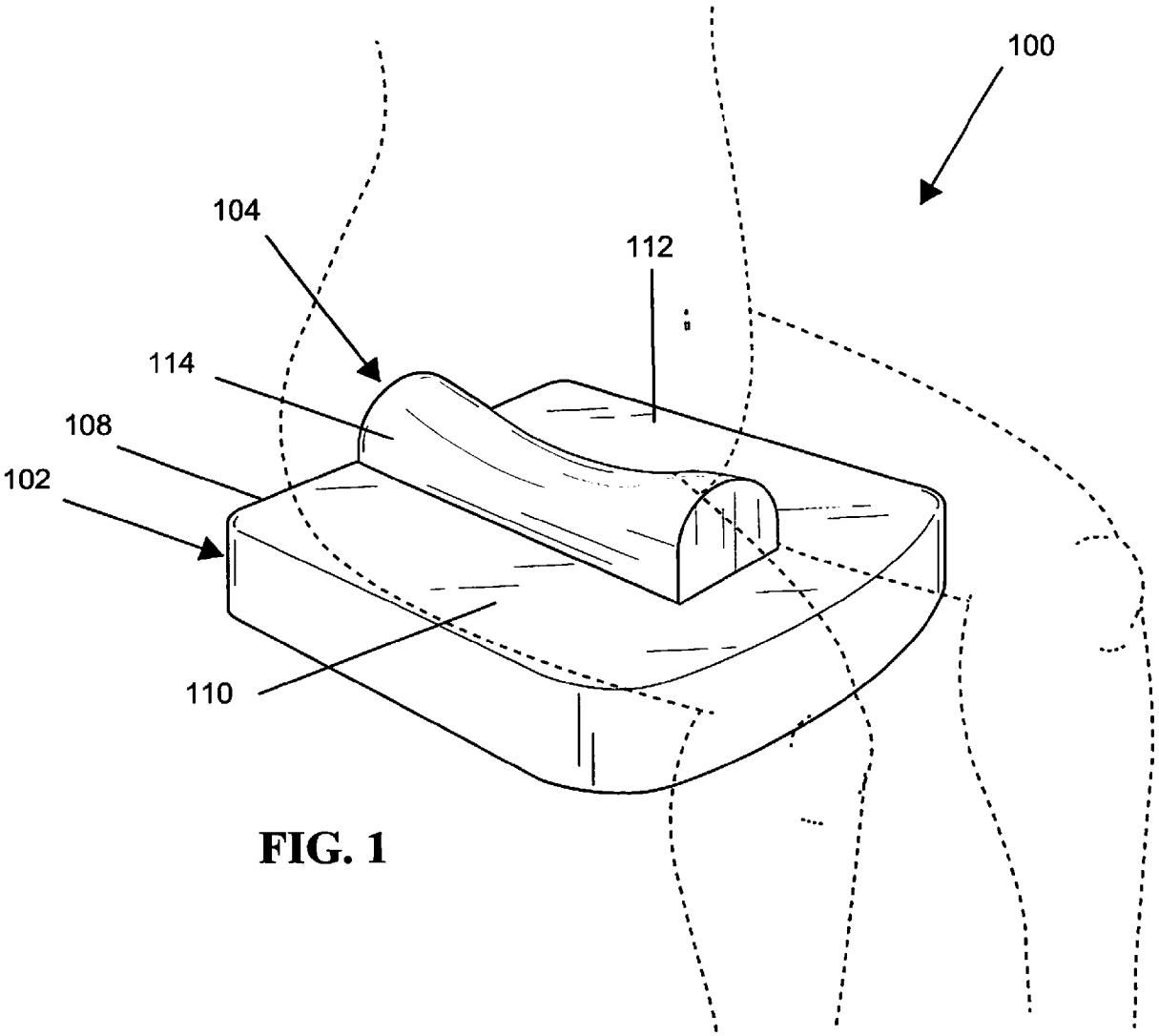
FIG. 1 is a perspective view of an exemplary use of a version of the present invention.

Referring now to the drawings wherein the showings are only for purposes of illustrating a preferred version of the invention and not for purposes of limiting the same.

The following detailed description is of the best currently contemplated modes of carrying out exemplary versions of the invention. The description is not to be taken in the limiting sense, but is made merely for the purpose of illustrating the general principles of the invention, since the scope of the invention is best defined by the appended claims.

Various inventive features are described below that can each be used independently of one another or in combination with other features.

With reference now to the drawings, and in particular to FIG. 1-FIG. 6 thereof, a new seating cushion embodying the principles and concepts of the present invention and generally designated by the reference numeral 100 will be disclosed.

Figure 2:
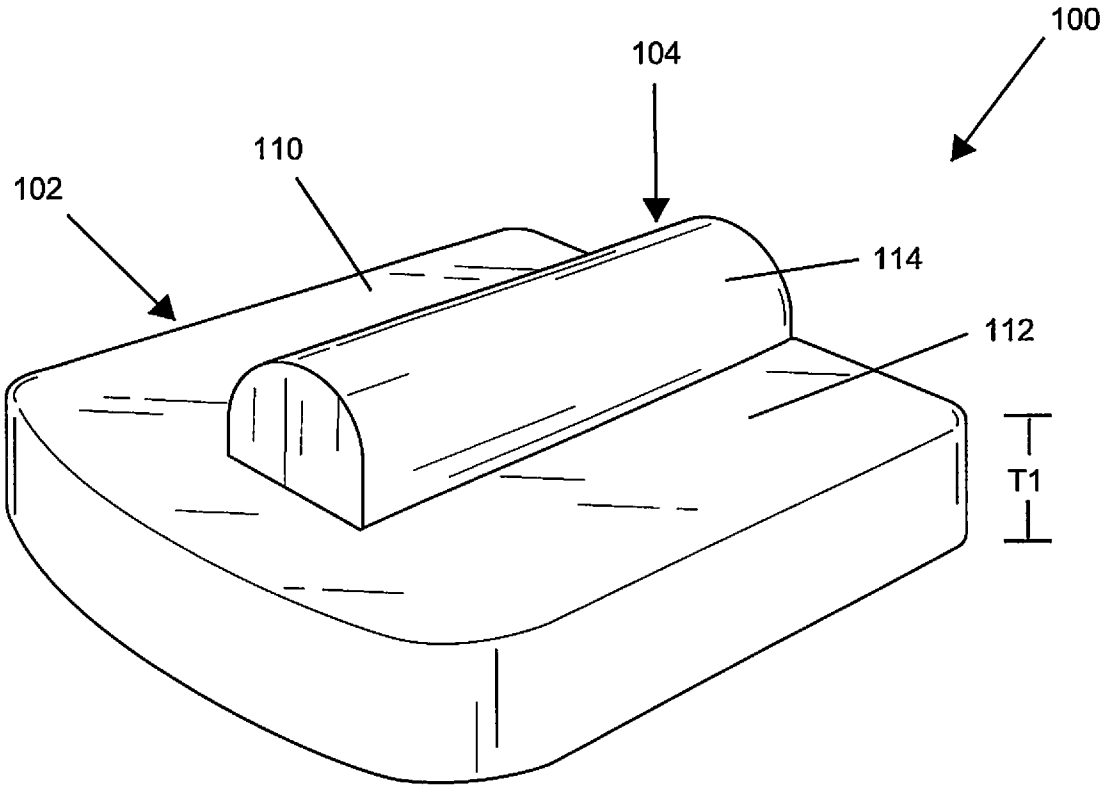
FIG. 2 is a perspective view of the version shown in FIG. 1.

The invention relates to a seating cushion that applies pressure to the crotch area of the user, which provides relief from pelvic pressure and discomfort. FIG. 1 illustrates a perspective view of an exemplary use of a version of the present invention, and FIG. 2 is another perspective view of the version shown in FIG. 1. In the version, the seating cushion 100 comprises a base cushion portion 102 for padding and an elevated and elongated central portion 104 for applying pressure to the crotch area of a user while the user is seated thereon.

Figure 4:
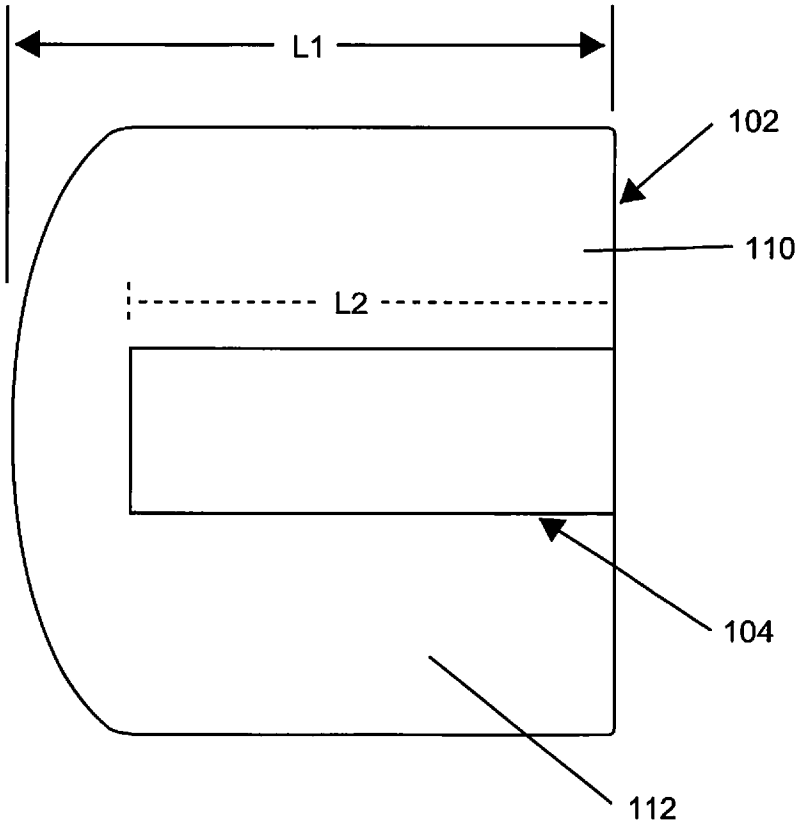
FIG. 4 is a top plan view of the version shown in FIG. 1.
Figure 3:
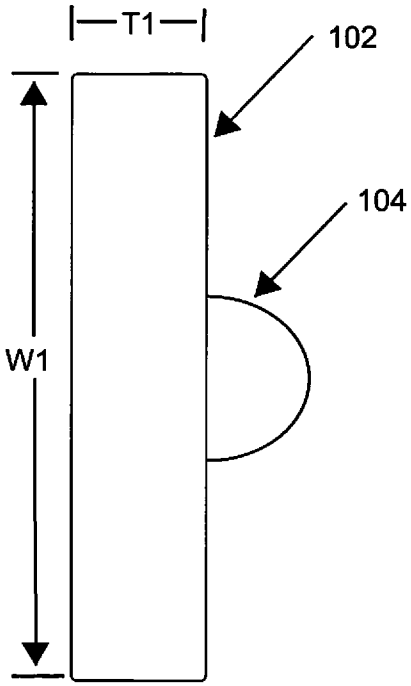
FIG. 3 is a front elevation view of the version shown in FIG. 1.
Figure 6:
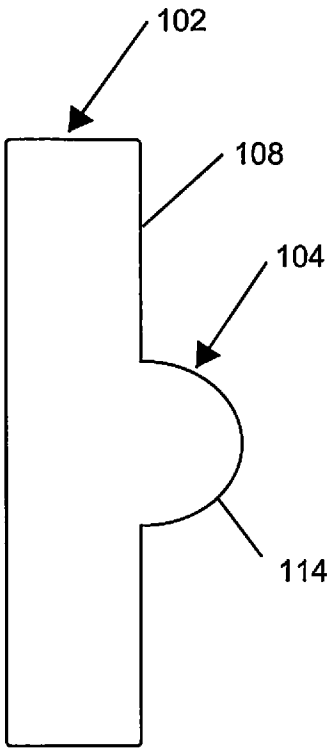
FIG. 6 is a rear elevation view of the version shown in FIG. 1.
Figure 5:
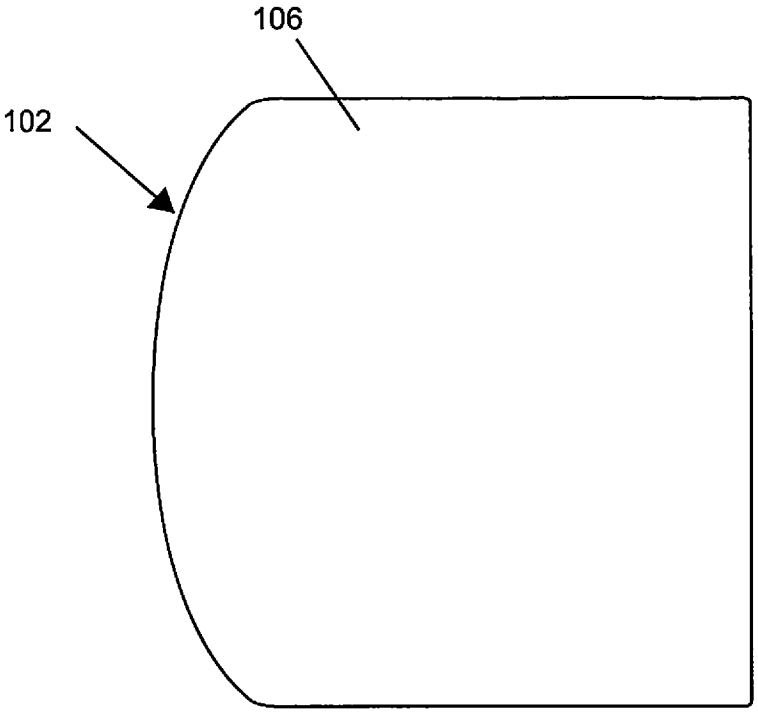
FIG. 5 is a bottom plan view of the version shown in FIG. 1.

As depicted in FIG. 1, the version of the invention generally has a rectangular shape and has a sufficient padding thickness T1 to provide comfort to the user while in the seated position. Further, the base cushion 102 portion has a substantially planar bottom surface 106 and a top surface 108 opposed to the bottom surface 106. The top surface 108 has laterally opposed left and right sides 110, 112 that are utilized to pad and support the user's thighs and buttocks while the seat is being utilized as illustrated in FIG. 1. The base cushion portion 102 can vary in size, shape and dimension depending on the size and weight of the user and their respective needs. The thickness T1 of the base cushion portion 102 can vary depending on the desired amount of cushion. The base cushion portion 102 can be made of foam, wool, feathers, synthetic materials, or any other materials that are suitable for providing a layer of cushion. Referring to FIG. 3 and FIG. 4, the length L1 of the base cushion portion 102 is preferably 14.5 inches and the width W1 of the cushion is preferably 15 inches.

Moreover, as depicted in FIG. 1-FIG. 6, the elevated and elongated central portion 104 for applying pressure to the crotch area of the user extends lengthwise a length L2 near the center of the base cushion portion 102 and between the left and right sides 110, 112 of the top surface 108. The elevated and elongated central portion generally has an outer curved surface 114. The length L2 is preferably equal to or less than the base cushion portion 102 length L1.

The elevated and elongated central portion 104 can be variably shaped, contoured, and sized providing that it sufficiently applies pressure to the user's crotch area. As depicted in FIG. 2, the elevated and elongated central portion is in the shape of a half cylinder horizontally extending lengthwise near the center of the base cushion portion 102 and between the left and right sides of the top surface 110, 112. Preferably the radius of the half cylinder is 1.5 to 2.0 inches.

Figure 12:
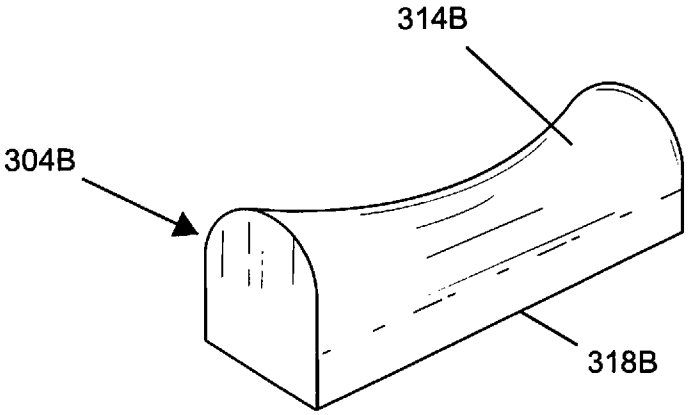
FIG. 12 is a perspective view of an alternative version of the elevated and elongated central portion.
Figure 13:
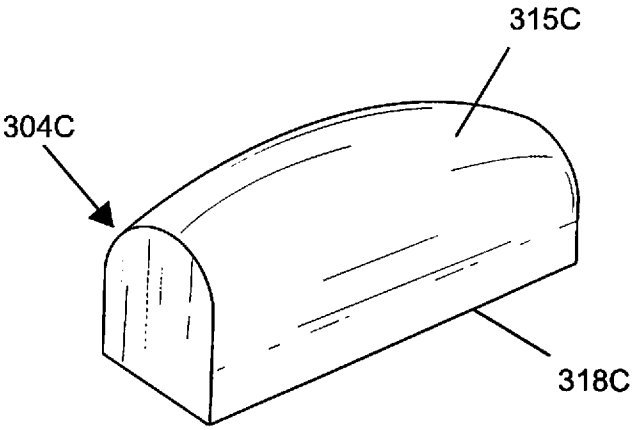
FIG. 13 is a perspective view of an alternative version of the elevated and elongated central portion.
Figure 11:
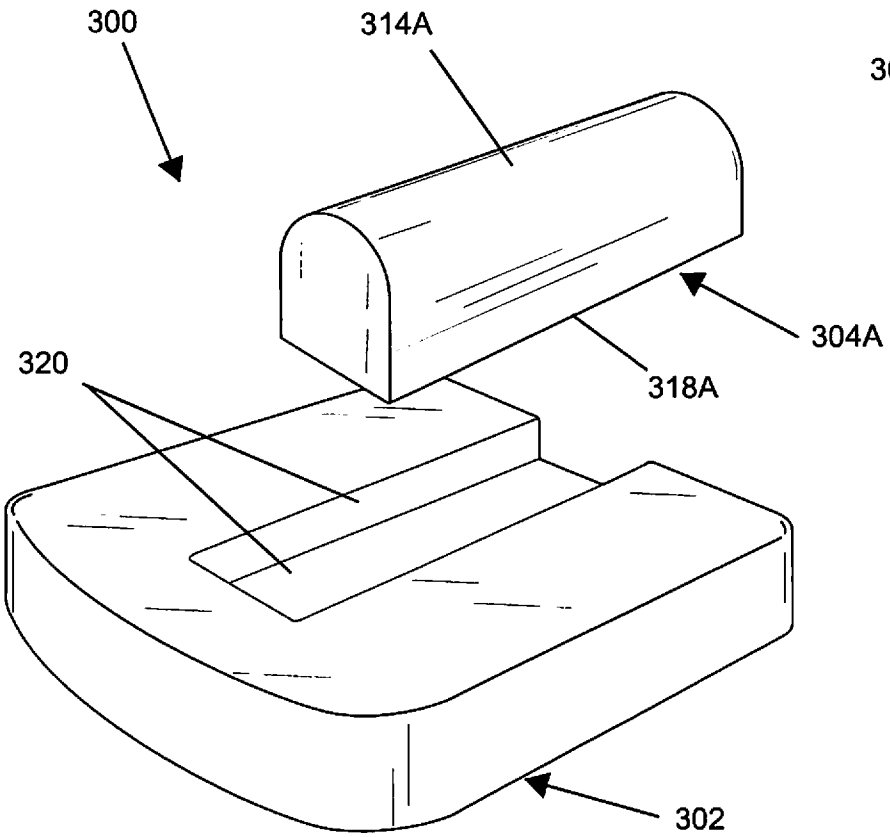
FIG. 11 is a perspective view of another version of the present invention.
Figure 15:
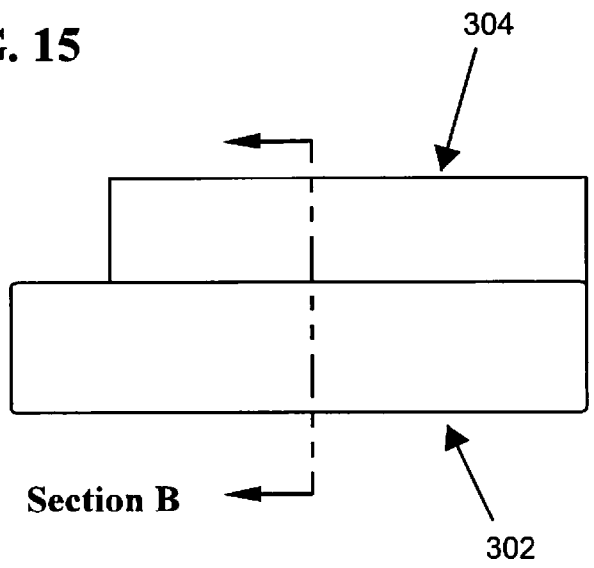
FIG. 15 is a right side elevation view of the version shown in FIG. 11.
Figure 14:
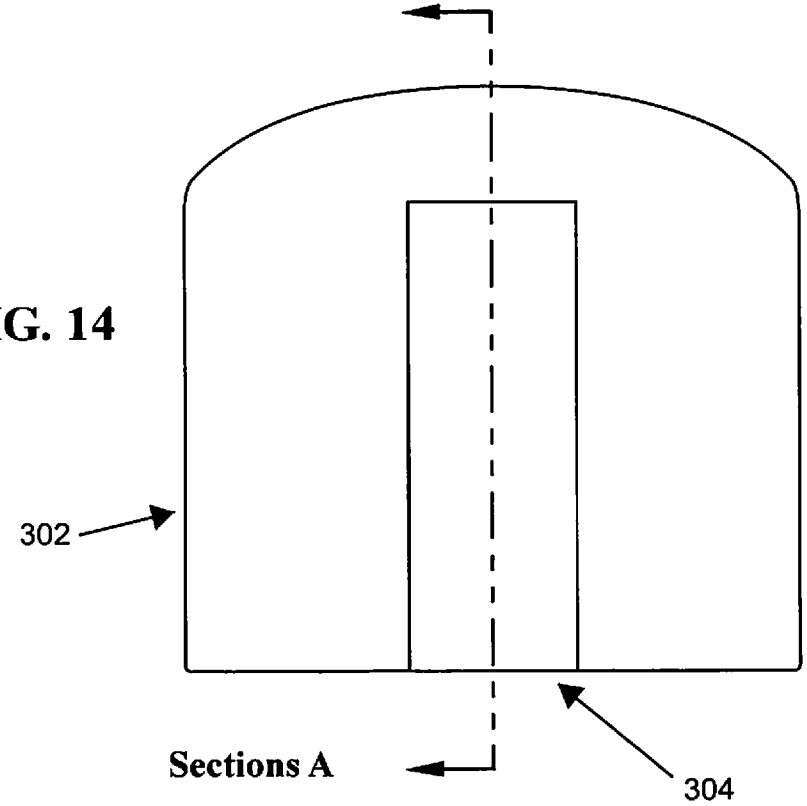
FIG. 14 is a top plan view of the version shown in FIG. 11.

Alternatively, the shape and outer curved surface of the elevated and elongated central portion 104 may be curved, convex, concave, spherical, parabolic, hyperbolic, mounded, or in any configuration that applies pressure to the crotch area of the user. The elevated and elongated central portions 314A-C (further discussed below) depicted in FIG. 11-FIG. 13, illustrate how the outer curved surface of the elevated and elongated central portion can be of a variable shape and elevation relative to the top surface of the base cushion portion. As illustrated in FIG. 12, the outer curved surface 315B is inwardly curved extending lengthwise. As illustrated in FIG. 13, the outer curved surface 315C is outwardly curved extending lengthwise.

In yet another version of the invention generally depicted by the reference numeral 200 in FIG. 7-FIG. 10, the elevated and elongated central portion 204 for applying pressure to the crotch area of the user is in the shape of a cylinder made of foam connected to the base cushion portion at a seam 216 extending lengthwise near the center of the base cushion portion 202. Preferably, the length L2 of the elevated and elongated central portion 204 is 11.5 inches with the radius R is between 1.5 and 2 inches.

Figure 7:
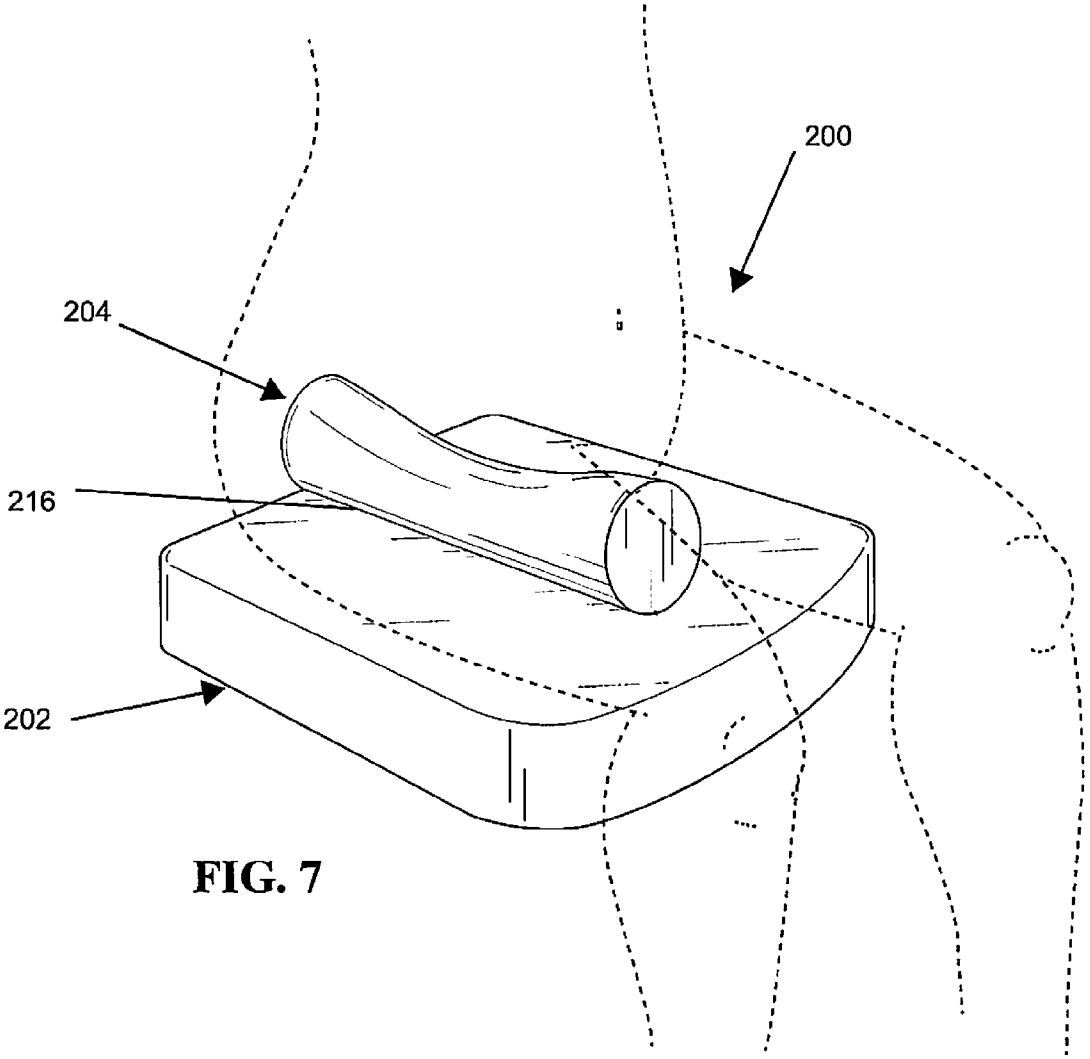
FIG. 7 is a perspective view of an exemplary use of another version of the present invention.
Figure 8:
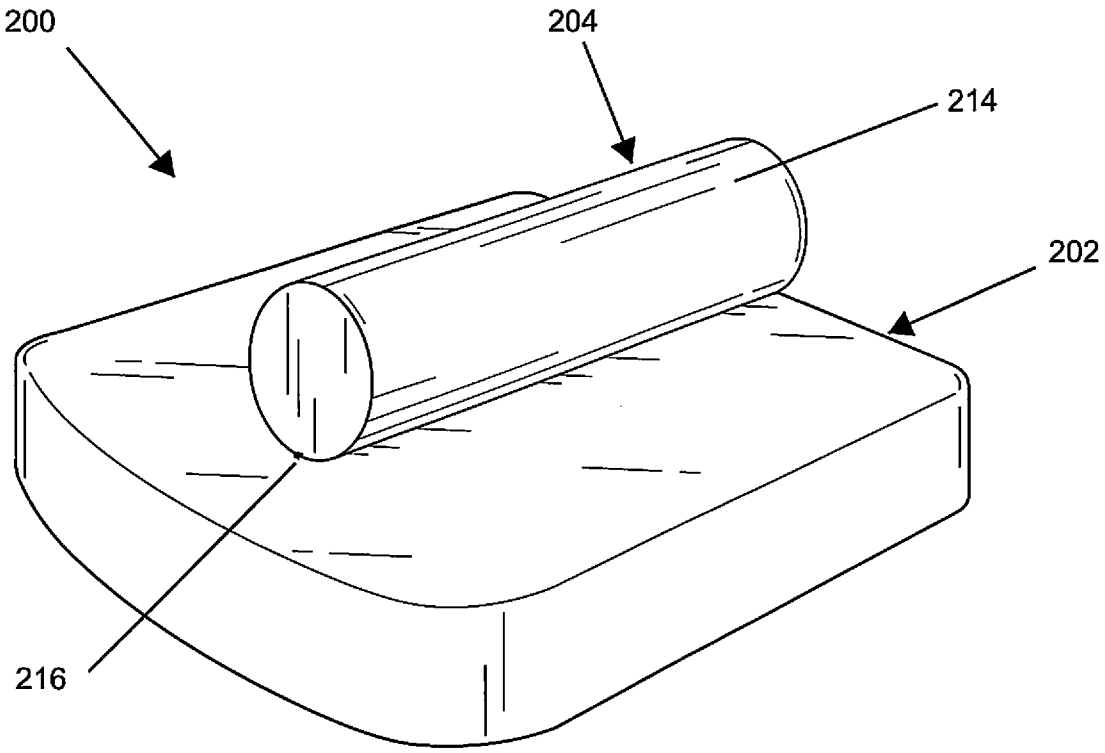
FIG. 8 is a perspective view of the version shown in FIG. 7.
Figure 10:
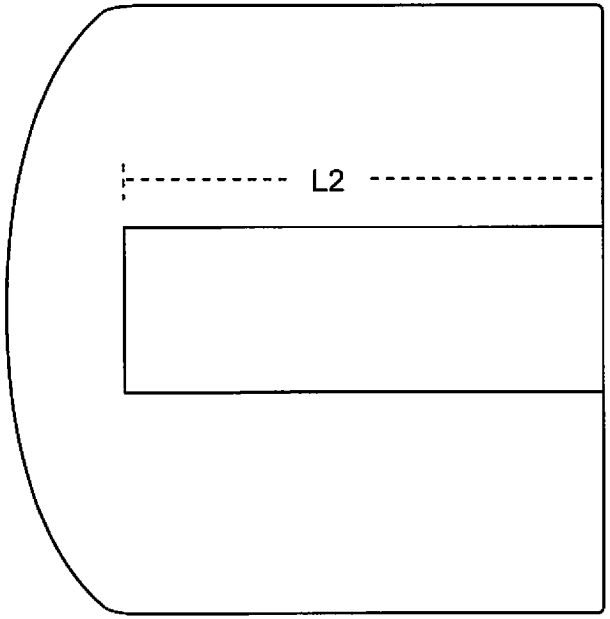
FIG. 10 is a top plan view of the version shown in FIG. 7.
Figure 9:
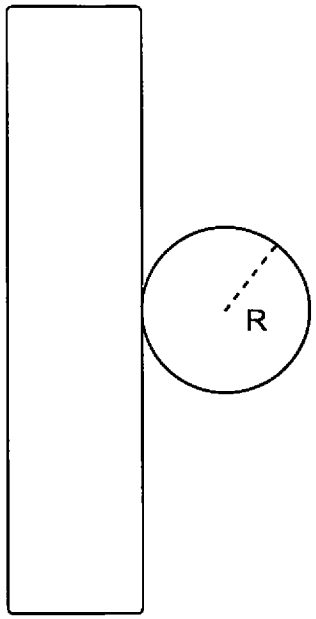
FIG. 9 is a front elevation view of the version shown in FIG. 7.

The elevated and elongated central portion can be made of any material that is sufficiently dense enough to apply pressure to the user's crotch area while the user is seated. Preferably, the material is made of sufficiently dense foam or other similar material that is comfortable, yet provides applied pressure to the crotch area as illustrated in FIG. 1 and FIG. 7.

Now referring to FIG. 11-FIG. 17, in another version of the invention generally depicted by reference numeral 300, the elevated and elongated central portions 304A-304C is removable and interchangeable with other interchangeable central portions that may optionally comprise a different density, shape, or size. Thus, if a user desires an interchangeable elevated and elongated central portion that provides different characteristics such as density and height, he or she can remove the current central portion from the cushion and replace it with another better suited portion providing the desired characteristics. Each user's needs may vary depending on the degree of pain and the condition of the user.

Figure 16:
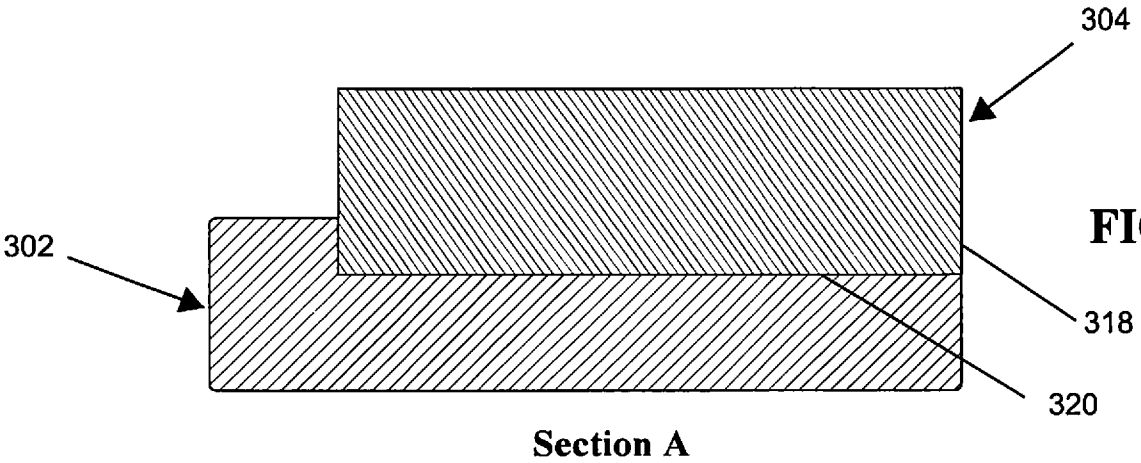
FIG. 16 is a cross-sectional view of the version shown in FIG. 11, taken along section line A of FIG. 14.
Figure 17:
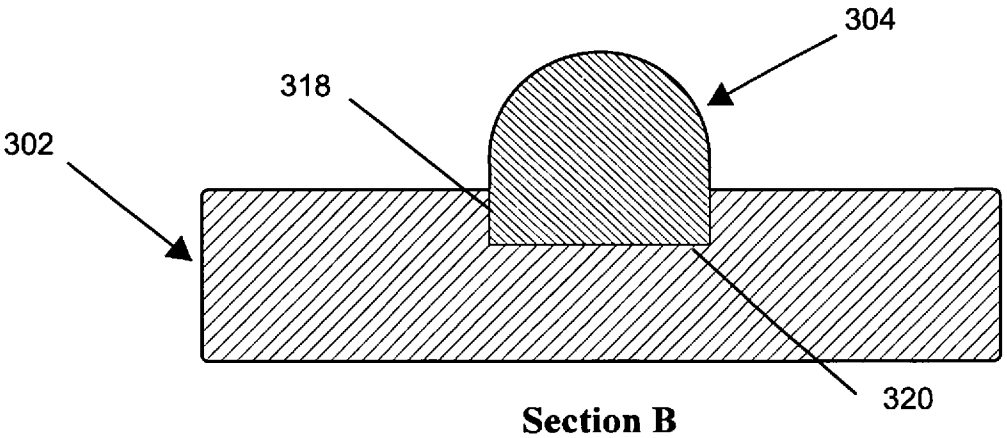
FIG. 17 is a cross-sectional view of the version shown in FIG. 11, taken along section line B of FIG. 15.

As illustrated in FIG. 11-FIG. 17, the elevated and elongated central portions 304A-304C further comprise a shaped seating base 318A-318C, which, for purposes of this version, is a rectangular base portion. The base cushion portion 302 further comprises a shaped impression 320, which, for purposes of this version, is a rectangular shaped impression adapted to fit and receive the shaped seating bases 318A-318C of the elevated and elongated central portions 304A-304C. This enables the elevated and elongated central portion to easily be removed and replaced by simply fitting the shaped seating base 318A into the shaped impression 320, thereby securely fitting the elevated and elongated central portion 304A in the proper position for application of the seating cushion. FIG. 16 and FIG. 17 show respective cross-sectional views of the version shown in FIG. 11, taken along section line A of FIG. 14 and section line B of FIG. 15.

Figure 18:
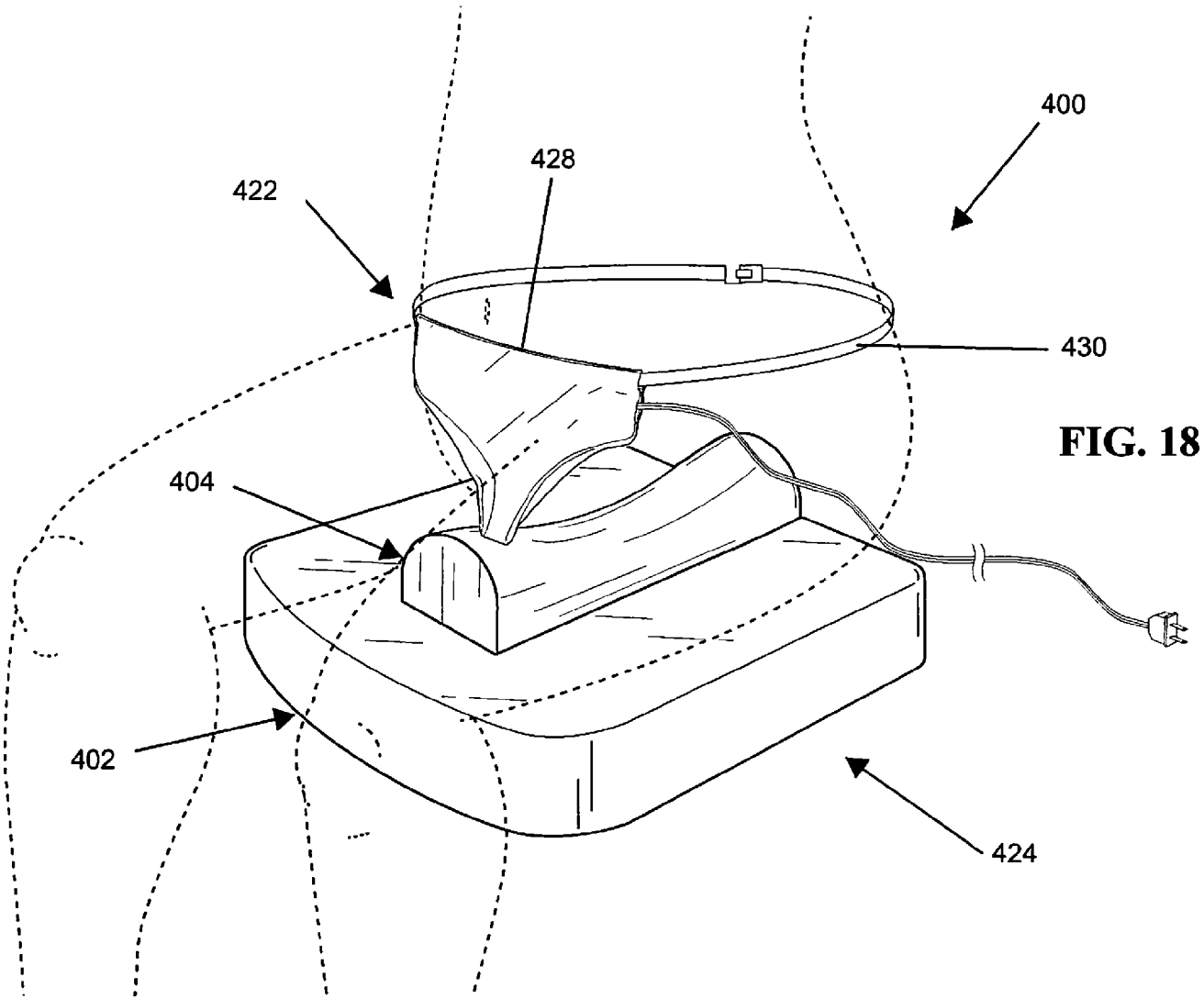
FIG. 18 is a perspective view of an alternative version that further comprises a heating apparatus.
Figure 20:
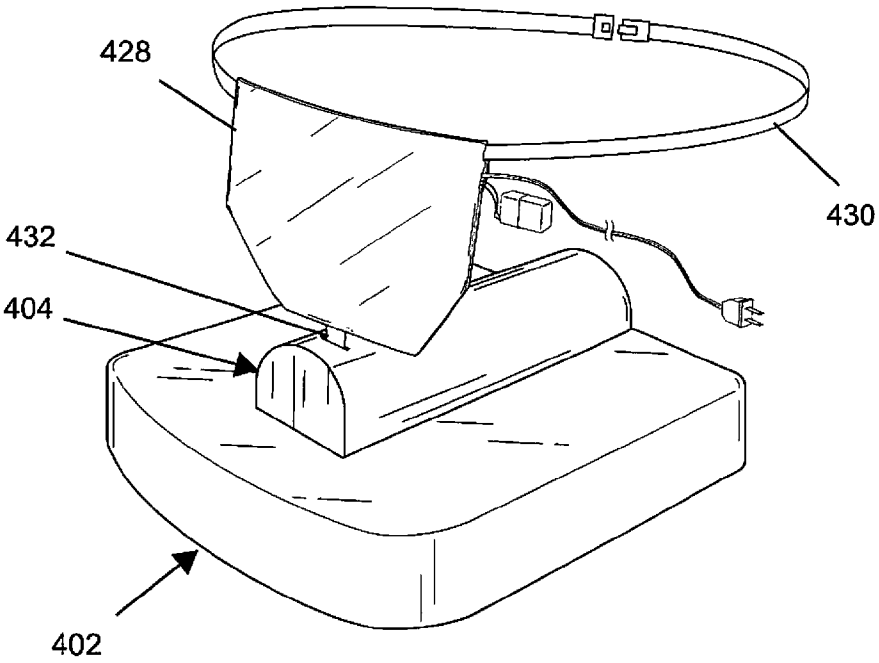
FIG. 20 is a perspective view of the version shown in FIG. 18.
Figure 19:
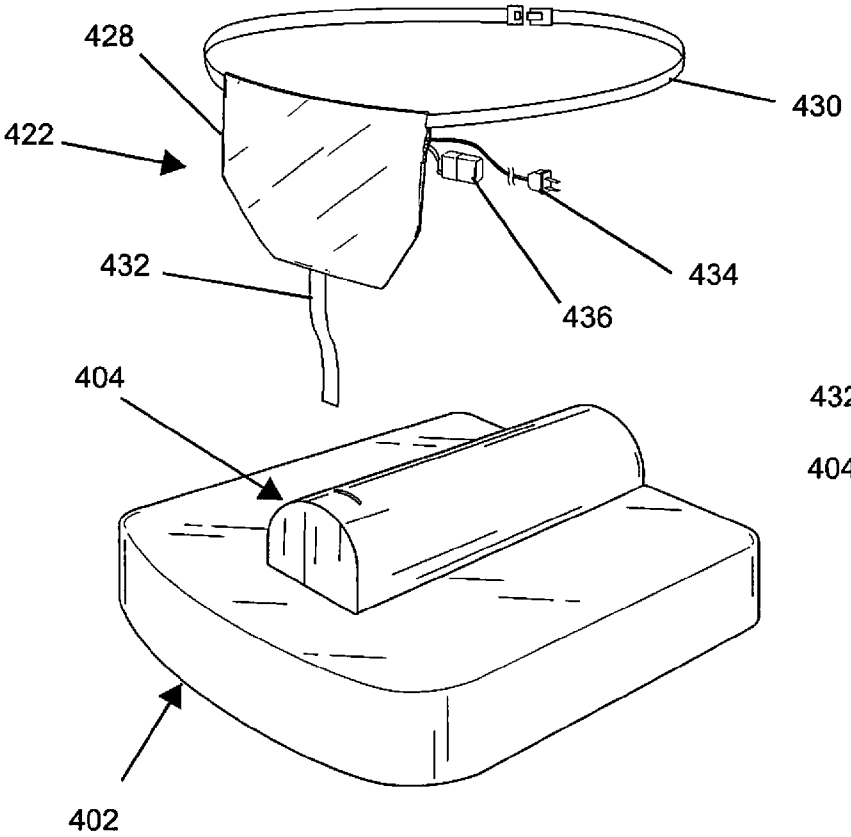
FIG. 19 is a perspective view of the version shown in FIG. 18.
Figure 21:
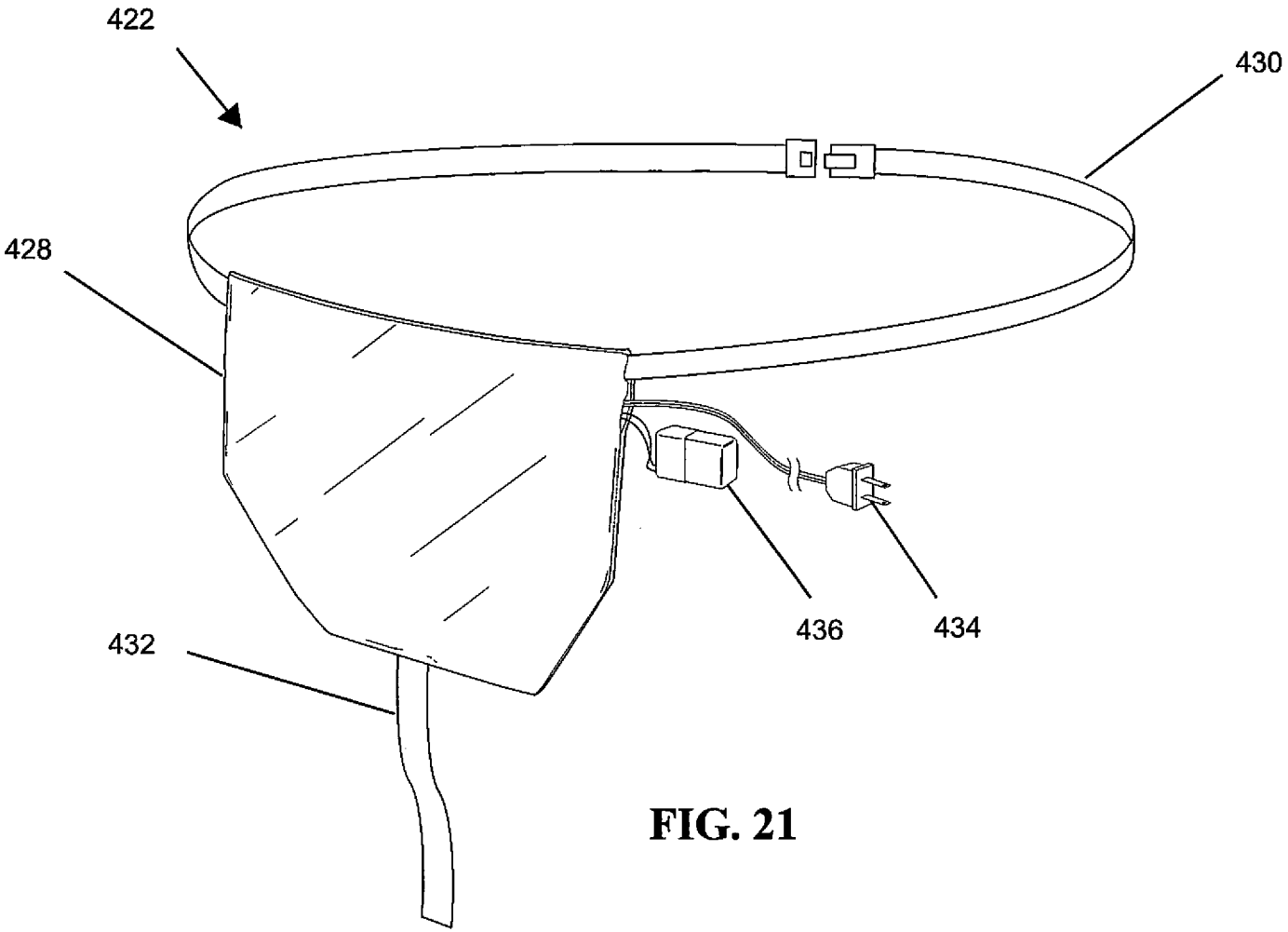
FIG. 21 is a detached perspective view of the heating apparatus of the version shown in FIG. 18.
Figure 22:
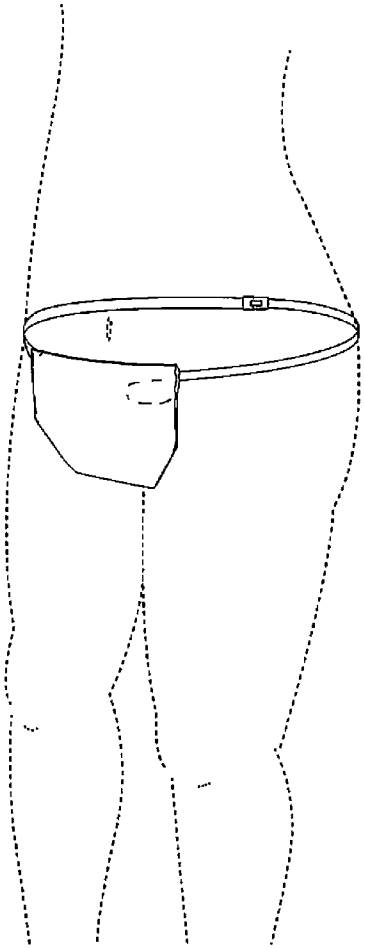
FIG. 22 is a perspective view of an exemplary detached use of the heating apparatus of the version shown in FIG. 18.

Now referring to FIG. 18-FIG. 22, another version of the invention is generally depicted as reference numeral 400. As illustrated in FIG. 18, a heating apparatus 422 is provided and utilized in conjunction with the seating cushion 424 as previously described. The heating apparatus 422 applies heat to the pelvic region in conjunction with the applied pressure from the elevated and elongated central portion 404 of the seating cushion 424. The applied heat to the pelvic frontal area, combined with the applied pressure of the cushion, significantly reduces pelvic area pain and pressure.

Preferably, as illustrated by FIG. 18-FIG. 22, the heating apparatus comprises a heating pad 428 that generally conforms to the shape of the frontal pelvic area and is held into place by a waist strap 430, which is optionally attached near the front of the seating cushion 424, base cushion portion 402, or near the front of the elevated and elongated central portion by a fastener 432. The fastener 432 can be a strap, adjustable strap, hook, button clip or anything that securely fastens the heating apparatus to the seating cushion.

Further, the heating pad may be powered by a wall outlet by a cord 434 or can be made rechargeable with a rechargeable battery pack 436. This combination of applied heat and pressure to the pelvic area provides the user with the ultimate in comfort, functionality, and utility.

Now referring to FIG. 1 and FIG. 7, the operation of the invention will be discussed. First the user places the seating cushion 100 on a supportive surface such as a chair, floor or bed. The user then sits on the seating cushion 100 fitting the elevated and elongated central portion 104 lengthwise within the user's crotch area, with the user's left and right thighs and buttocks sitting on the left and right sides 110, 112 of the top surface 108 of the seating cushion respectively. The downward weight of the user creates an upward applied pressure to the crotch area and pelvic region and a seated cushion to thighs and buttocks.

Now referring to FIG. 18-FIG. 22, the operation of the optional heating apparatus 422 in conjunction with the seating cushion 424 will be discussed. Firstly, the user places the heating pad 428 near the front pelvic area and secures in place by the waist strap 430. User then sits down on the seating cushion 424 as described above. The user then has the option of securing the heating pad 428 to the seating cushion 424 by the fastener 432 or as depicted in the version a strap and is fastened near the front of the elevated and elongated central portion 404. The fastener 432 coupled with the waist strap 430 can be adjusted to provide a conforming fit of the heating apparatus 422 covering the front pelvic area. User also has the option to release the fastener 432 from the seating cushion 424 providing the user with the ability to utilize the heating apparatus 422 without the seating cushion 424.

The present invention can be made in any manner and of any material chosen with sound engineering judgment. Preferably, materials will be strong, lightweight, long lasting, economic, and ergonomic, such as a light weight foam with sufficient density.

The previously described versions of the present invention have many advantages, including providing an cushion apparatus that is simple and provides for a safe and reliable treatment of pelvic pain and discomfort.

The invention does not require that all the advantageous features be incorporated into every version of the invention.

Although preferred versions of the invention have been described in considerable detail, other versions of the invention are possible.

All the features disclosed in this specification (including and accompanying claims, abstract, and drawings) may be replaced by alternative features serving the same, equivalent or similar purpose unless expressly stated otherwise. Thus, unless stated otherwise, each feature disclosed is one example only of a generic series of equivalent or similar features.

What is claimed is:

1. A seating cushion for applying pressure to the pelvic crotch area of a user, comprising:

a) a base cushion portion for providing padding having a front end and a rear end defining a base cushion portion length, the base cushion portion comprising:
   i) a bottom surface,
   ii) a top surface opposed to the bottom surface, the top surface having laterally opposed left and right sides for adapting to user's thighs and buttocks while the user is seated thereon, and
   iii) wherein the base cushion portion generally having a padding thickness and a length; and b) an elevated and elongated central portion for applying pressure to the pelvic crotch area of a user while the user is seated thereon, the elevated and elongated central portion comprises an outer curved surface having a constant vertical height greater than a remainder of the base cushion portion, a rear end of the central portion being even with the rear end of the base cushion portion, and the central portion having a length less than the base cushion portion length, whereby extending substantially lengthwise within the user's crotch area and buttocks between the right and left sides of the top surface; wherein a remaining portion extends between a front end of the central portion and a front end of the base cushion portion in order to accommodate the user's legs and increase stability.

2. The seating cushion of claim 1, wherein the elevated and elongated central portion is substantially in the shape of a half cylinder extending lengthwise near the center of the base cushion portion.

3. The seating cushion of claim 1, wherein the elevated and elongated central portion is made of foam.

4. The seating cushion of claim 1, further comprising a heating pad attached to the central portion and having a top portion and a bottom portion for applying heat to a front pelvic area of the user, wherein the heating pad vertically narrows in width from the top portion to the bottom portion.

5. The seating cushion of claim 4, wherein the heating pad further comprises a waist strap for supporting the heating pad adjacent to the front pelvic area of the user.

6. The seating cushion of claim 5, wherein the heating pad is attached to the seating cushion by a fastener, whereby the user can securely fasten the heating pad to the seating cushion or unfasten for detached use of the heating pad.

7. The seating cushion of claim 6, wherein the heating pad further comprises a rechargeable battery for cordless operation.

* * * * *